US005667020A

United States Patent [19]

Palmer et al.

[11] Patent Number: 5,667,020

[45] Date of Patent: Sep. 16, 1997

[54] CIRCLE AND DRAWBAR ASSEMBLY FOR A MOTOR GRADER

[75] Inventors: Richard D. Palmer, Green Valley, Ariz.; Joseph A. Rapp, Morris, Ill.

[73] Assignee: Caterpillar Inc., Peoria, Ill.

[21] Appl. No.: 592,105

[22] Filed: Jan. 26, 1996

[51] Int. Cl.[6] ..... E02F 3/12

[52] U.S. Cl. ..... 172/781; 172/797; 74/448

[58] Field of Search ..... 172/781, 747, 172/796, 795, 797, 792, 793, 791; 74/447, 448

[56] References Cited

U.S. PATENT DOCUMENTS

| | | | |
|---|---|---|---|
| 1,247,719 | 11/1917 | Reese | 172/781 |
| 2,313,084 | 3/1943 | Manly | 212/68 |
| 3,008,312 | 11/1961 | Jacobus | 64/9 |
| 3,439,551 | 4/1969 | Militana | 74/243 |
| 3,888,357 | 6/1975 | Bauer et al. | 212/68 |
| 3,971,146 | 7/1976 | Hyler | 37/8 |
| 4,004,641 | 1/1977 | Hendrickson | 172/781 |
| 4,031,967 | 6/1977 | Atherton et al. | 172/795 |
| 4,060,136 | 11/1977 | Hendrickson et al. | 172/795 |
| 4,064,947 | 12/1977 | Cole | 172/781 |
| 4,074,767 | 2/1978 | Cole | 172/781 |
| 4,099,577 | 7/1978 | Beckham et al. | 172/781 |
| 4,113,032 | 9/1978 | Cole | 172/781 |
| 4,122,903 | 10/1978 | Cole | 172/781 |
| 4,206,818 | 6/1980 | Beckham et al. | 172/781 |
| 4,622,860 | 11/1986 | Cametti et al. | 74/448 |
| 5,279,173 | 1/1994 | Blaszynski et al. | 74/448 |
| 5,347,880 | 9/1994 | Kallenberger | 74/447 |
| 5,553,367 | 9/1996 | Mahoney | 29/402.08 |

*Primary Examiner*—Terry Lee Melius
*Assistant Examiner*—Victor Batson
*Attorney, Agent, or Firm*—Dennis C. Skarvan; William C. Perry

[57] ABSTRACT

A blade assembly of a motor grader includes a drawbar frame adapted for mounting to the motor grader and a circle frame adapted for mounting a blade thereto. A number of shoe assemblies are mounted to the drawbar frame in a circular array and support the circle frame and blade for rotational movement against the drawbar frame. The circle frame includes a circular frame portion and a number of ring gear segments mounted to the circular portion in a circular array. Each of the ring gear segments includes gear teeth adapted for engaging drive means of the drawbar frame. The circular portion and the ring gear segments define an assembly slidingly received between the shoe assemblies and the drawbar frame. The circular portion is slidingly received against the shoe assemblies, and the ring gear segments are slidingly received against the drawbar frame. Bearing members are disposed between the circular portion and the shoe assemblies and between the ring gear segments and the drawbar frame.

7 Claims, 3 Drawing Sheets

CIRCLE AND DRAWBAR ASSEMBLY FOR A MOTOR GRADER

TECHNICAL FIELD

The present invention relates generally to blade mounting assemblies for motor graders and, more particularly, to a blade mounting assembly having ring gear segments mounted to a blade frame wherein the gear segments and blade frame are supported by a drawbar frame.

BACKGROUND ART

Motor grader type construction machinery mount the motor grader blade or moldboard to a blade support frame. The blade support frame is rotatably mounted to a drawbar frame and typically includes a ring gear which engages a drive pinion of a motor mounted to the drawbar frame for rotating the blade relative to the drawbar frame and motor grader.

Prior motor grader assemblies mount the blade support frame to the drawbar using a number of shoe assemblies attached to the drawbar in a circular array and which support the blade support frame from the drawbar via the ring gear. Shims are used to set the individual clearances between the shoe assemblies and the drawbar. See for example U.S. Pat. No. 4,206,818.

Segmented ring gears are known for use with the combination swing gear and bearing for the slewing platform of a hydraulic excavator. For example, in U.S. Pat. No. 3,888,357, the combination swing gear and bearing comprises a plurality of gear segments detachably secured to one race member of the bearing assembly in a manner to form a continuous annular gear.

However, the blade support frame and ring gear of motor graders have heretofore been an integral assembly; that is, a one-piece ring gear attached to a blade support frame. As a result, when individual ring gear teeth break, for example due to shock loading of the blade, the entire blade support frame must be disassembled from the motor grader and the ring gear must be replaced. Reassembling the blade support frame to the drawbar requires reshimming of the ring gear relative to the shoe assemblies. Both the cost of the replacement ring gear and the cost in downtime of the machine result in significant repair expense for this procedure. This cost increases dramatically with the size of the motor grader, which for example can include blade lengths of up to 24 feet or more.

What is needed is a blade assembly for a motor grader which combines the ease of service found in the combination swing gear and bearing assembly of excavators with the simple blade mounting arrangement of current motor graders.

DISCLOSURE OF THE INVENTION

According to one embodiment of the present invention, a blade assembly of a motor grader is disclosed comprising a drawbar frame adapted for mounting to the motor grader, a number of shoe assemblies mounted to the drawbar frame in a circular array, a blade support frame adapted for mounting a blade thereto, the blade support frame including a circular portion slidably disposed between the number of shoe assemblies and the drawbar frame, a number of ring gear segments mounted to the circular portion in a circular array, each of the number of ring gear segments including gear teeth adapted for engaging drive means of the drawbar frame, a number of fasteners for mounting the number of ring gear segments to the circular portion of the blade support frame.

According to another embodiment of the present invention, a work element assembly of a construction machine is disclosed comprising a first frame adapted for mounting to the construction machine and supporting a second frame, the first frame including a first bearing surface and a second bearing surface, a second frame adapted for mounting the work element thereto, the second frame including a circular portion, a number of ring gear segments mounted to the circular portion in a circular array, each of the number of ring gear segments including gear teeth adapted for engaging drive means of the first frame to rotate the second frame relative to the first frame, the circular portion and the number of ring gear segments defining an assembly slidingly disposed between the first bearing surface and the second bearing surface, a number of first bearing members disposed between the circular portion and the first bearing surface, a number of second bearing members disposed between the number of ring gear segments and the second bearing surface.

According to another embodiment of the present invention, a method for mounting a blade assembly to a motor grader is disclosed, the motor grader including a blade support frame and a drawbar frame, the method comprising the steps of (a) mounting a number of ring gear segments to the blade support frame in a circular array, each of the ring gear segments including gear teeth adapted for engaging drive means of the drawbar frame, (b) mounting a number of shoe assemblies to the drawbar frame and slidably restraining the blade support frame and the number of ring gear segments between the number of shoe assemblies and the drawbar frame for rotation relative thereto, and (c) removing one of the ring gear segments from the blade support frame without removing one or more of the number of shoe assemblies or otherwise disassembling the blade support frame from the drawbar frame.

BEST MODE FOR CARRYING OUT THE INVENTION

Figure 1:
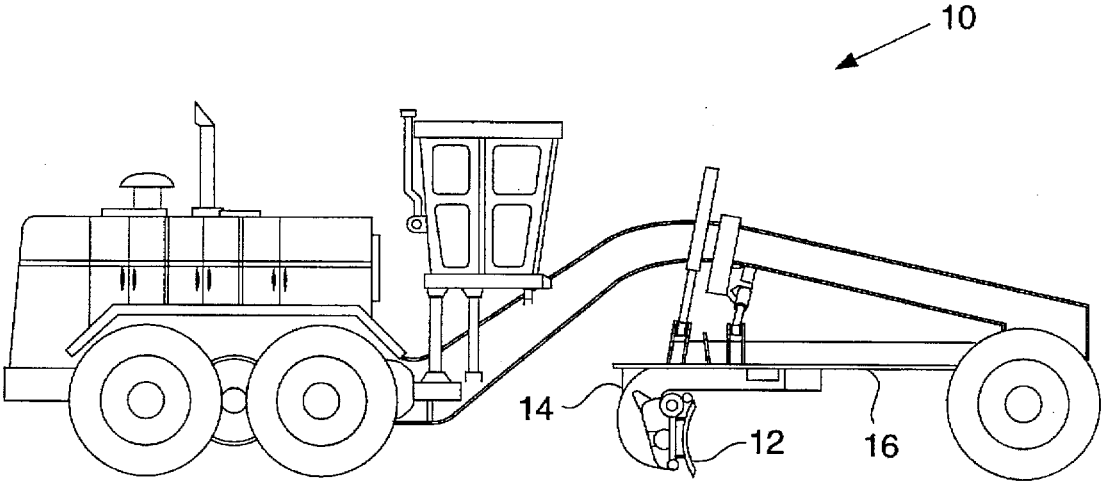
FIG. 1 is a side elevational view of a motor grader according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, an article of construction machinery 10 is shown in the form of a motor grader. The motor grader is typical of machines 10 contemplated by the present invention in that it includes a work element 12, for example a blade 12 of the motor grader as depicted in this specific preferred embodiment, connected to a blade support frame and ring gear assembly 14. Assembly 14 is rotatably connected to a frame 16 of machine 10, for example a drawbar frame 16 of the motor grader as depicted in this specific preferred embodiment.

Figures 2, 3:
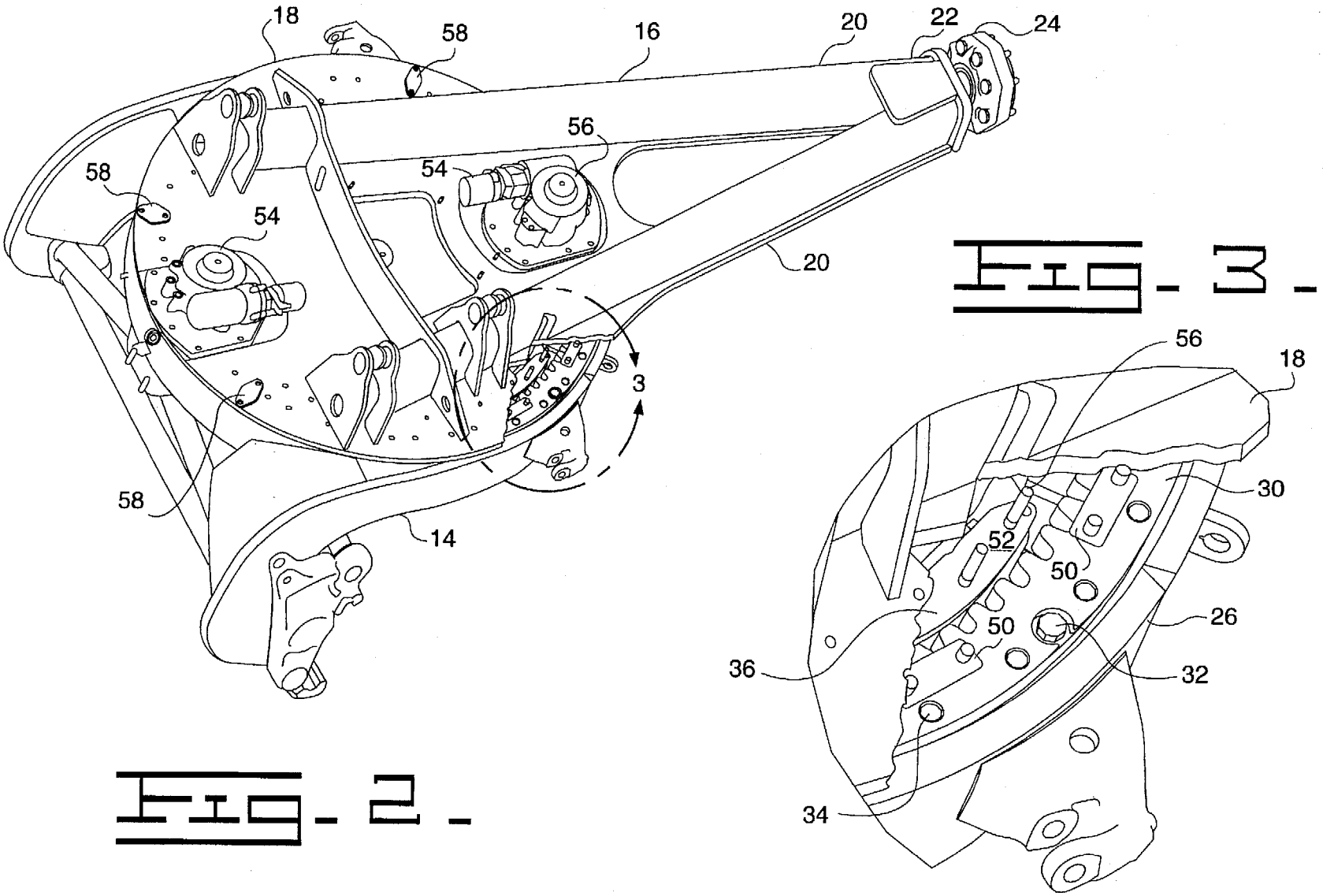
FIG. 2 is a top perspective view of the drawbar a e support frame of the motor grader of FIG. 1.
FIG. 3 is an exploded view of a portion of the drawer frame and blade support frame of FIG. 2 in which a gear tooth segment and shoe assembly are broken out.

Referring now to FIGS. 2 through 5, the drawbar frame 16 and blade support frame and ring gear assembly 14 is shown in greater detail. In FIG. 2, the drawbar frame 16 includes a circular frame portion 18 attached to tubular frame portions 20. Frame portions 20 intersect at an end 22 of drawbar frame 16. A spherical bearing assembly 24 is attached to end 22 and facilitates the articulated motion of drawbar frame 16 relative to machine 10.

Figure 4:
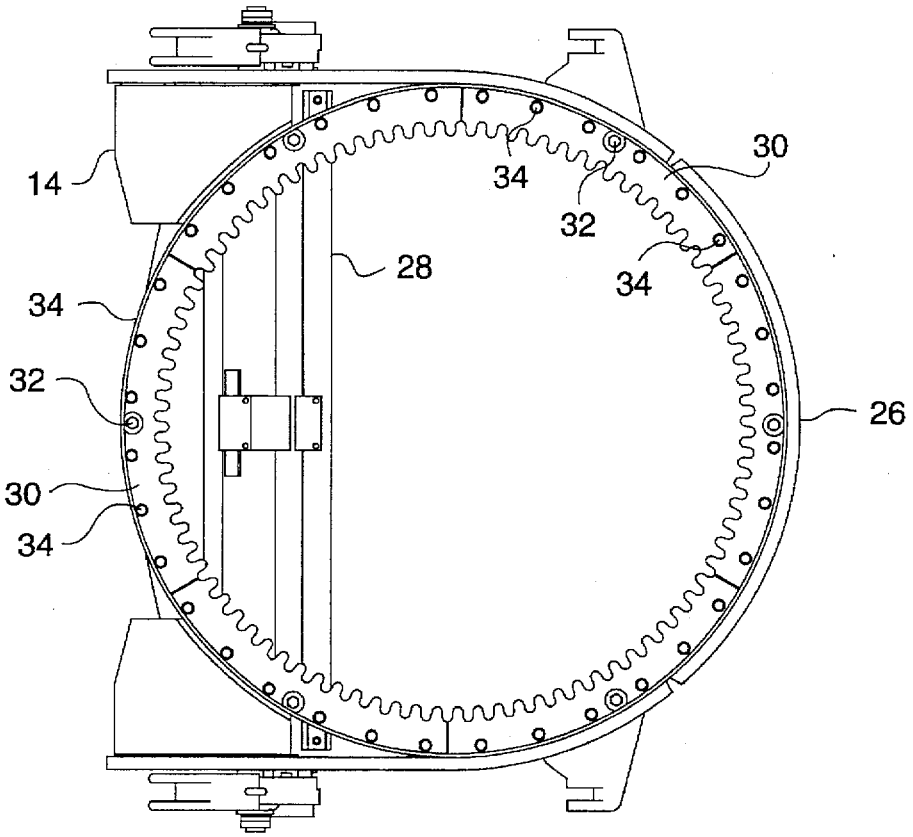
FIG. 4 is a top plan view of the blade support frame of FIG. 1.
Figure 5:
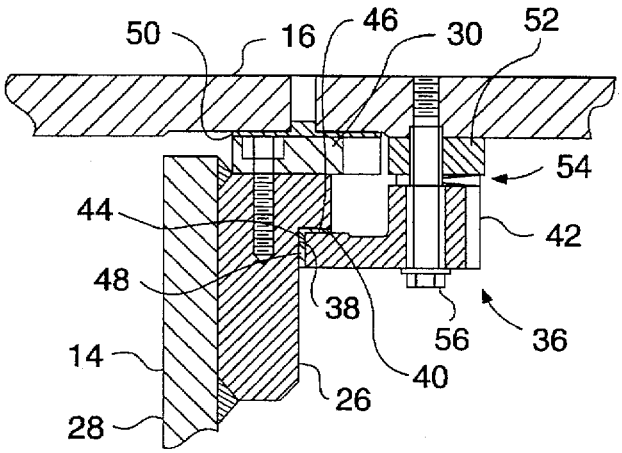
FIG. 5 is a side elevational, cross-sectional view of the drawbar frame and blade support frame of FIG. 1.

In FIGS. 3 through 5, the attachment of the blade support frame and ring gear assembly 14 to drawbar 16 is shown in greater detail. Prior art frame and ring gear assemblies, such as those typified by U.S. Pat. No. 4,206,818, include a one-piece forged and heat treated ring gear attached to a frame which supports the work element. The entire frame and ring gear assembly is supported by the one-piece ring gear via shoe assemblies which are fastened to the drawbar frame in a circular array and which extend downwardly and below the ring gear teeth to clamp the ring gear teeth between the shoe assemblies and the drawbar frame. Bearing strips facilitate the relative sliding motion between the ring gear teeth and shoe assemblies on one side and between the ring gear teeth and drawbar frame on the other side.

In FIGS. 4 and 5, the blade support frame and ring gear assembly 14 is shown in greater detail. Assembly 14 includes a circular frame portion 26 attached to a work element frame portion 28. In the specific preferred embodiment, the various frame portions are welded together; however, castings and other attachment means known in the art can be employed to provide the frame structure. Unlike the prior art blade support frame and ring gear assembly of U.S. Pat. No. 4,206,818 which supports the entire frame from the ring gear teeth, assembly 14 is supported by the frame itself thus tending to provide a more sturdy structure (FIG. 5).

Still further unlike the prior art circle frame and ring gear assembly of U.S. Pat. No. 4,206,818 which includes a one-piece ring gear, assembly 14 mounts ring gear segments 30 to circular frame portion 26. In particular, six (6) identical ring gear segments are attached to frame portion 26 to define a 360 degree ring gear. In the specific preferred embodiment, each ring gear segment 30 comprises 60 degrees of the 360 degree gear span and includes 15 gear teeth. Further in the specific preferred embodiment, each ring gear segment 30 is fastened to frame portion 26 by one ground body bolt 32 and six (6) otherwise standard fasteners 34. Bolt 32 positions the gear segment and reacts shear loading across the gear segment. Fasteners 34 provide the clamping force to fasten the gear segments to frame portion 26.

In FIGS. 3 and 5, eight (8) shoe assemblies 36 are mounted to drawbar frame 16 in a circular array and support frame portion 26 against portion 18 of drawbar frame 16. In particular, frame portion 26 is generally L-shape in cross-section to define a first or vertical bearing surface 38 and a second or lateral bearing surface 40. Similarly, shoe assembly 36 includes a generally L-shaped member 42 which defines corresponding first and second bearing surfaces 44 and 46. Eight (8) bearing strips 48, generally L-shape in cross-section and corresponding to bearing surfaces 38 and 40 on the outer side and bearing surfaces 44 and 46 on the inner side, are disposed between members 42 of shoe assemblies 36 and frame portion 26. Bearing strips 48 otherwise correspond in profile to member 42 of shoe assembly 36 similar to the bearing strips of U.S. Pat. No. 4,206,818, the contents of which are hereby incorporated by reference.

Bearing strips 50 are similarly provided between gear segments 30 and portion 18 of drawbar frame 16. In particular, two (2) bearing strips are provided for each segment 30. Each bearing strip is a thin planer member and spans approximately two teeth of the gear segment.

Shoe assemblies 36 further include a base member 52 separate from L-shaped portion 42. One or more shims 54 are disposed between the members 42 and 50 to selectively match the assembled stack of gear segment 30 and frame portion 26. Fasteners 56 clamp members 42 and 52 and shims together and to portion 18 of drawbar frame 16.

In operation, a pair of hydraulic motors 54 drive the ring gear segments 30 via a pair of pinion gears (not shown) to rotate the blade 12 relative to drawbar frame 16. As the blade 12 impacts hardened objects such as rocks and boulders during a grading operation, loads are absorbed by a pair of clutch packs 56 which operate to disengage the drive motors from the pinion gears. Nevertheless, repeated shock loading of the gear segments can result in tooth breakage of a particular segment. Four access openings, shown covered by plates 58, are provided in portion 18 of drawbar frame 16 for permitting access to fasteners 32 and 34. Upon removal of fasteners 32 and 34, the affected gear segment is removed and another inserted in its place. This repair is accomplished without otherwise disassembling the circle frame from the drawbar frame or disassembling the remaining ring gear segments from the circle frame.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A blade assembly of a motor grader, comprising:

a drawbar frame adapted for mounting to the motor grader;

a blade support frame having a circular portion and being adapted for mounting a blade thereto;

a number of shoe assemblies having a first shoe member defining a first bearing surface, a second shoe member, and a number of shims clamped between said first and second shoe members, said shoe assemblies being mounted to said drawbar frame in a circular array with the circular portion of the blade support frame slidably disposed between the first bearing surface and said drawbar;

a number of ring gear segments mounted to said circular portion in a circular array, each of said number of ring gear segments including gear teeth adapted for engaging drive means of said drawbar frame;

a number of fasteners for mounting said number of ring gear segments to said circular portion of said blade support frame.

2. The blade assembly of claim 1, wherein each of said number of fasteners includes a tool engaging end disposed adjacent to said drawbar frame and said drawbar frame includes a number of access ports for permitting access to said tool engaging ends of said number of fasteners.

3. The blade assembly of claim 1, wherein said drawbar frame includes a circular frame portion attached to two tubular frame portions, said tubular frame portions intersecting at an end which is adapted for mounting a spherical bearing assembly thereto.

4. The blade assembly of claim 1, wherein said number of fasteners includes first and second fasteners corresponding to one of said number of ring gear segments, said first fastener positioning said one ring gear segment relative to said circular portion and said second fastener clamping said one ring gear segment to said circular portion.

5. The blade assembly of claim 1, wherein said circular portion and said number of ring gear segments define an assembly slidingly received between said number of shoe assemblies and said drawbar frame, said circular portion being slidingly received against said number of shoe assemblies and said number of ring gear segments being slidingly received against said drawbar frame.

6. The blade assembly of claim 5, and further comprising a number of first bearing members disposed between said circular portion and said number of shoe assemblies and a number of second bearing members disposed between said number of ring gear segments and said drawbar frame.

7. A work element assembly of a construction machine, comprising:

a first frame adapted for mounting to the construction machine and supporting a second frame, said first frame including a number of shoe assemblies having a first shoe member defining a first bearing surface, a second shoe member, and a number of shims clamped between said first and second shoe members and a second bearing surface;

a second frame adapted for mounting the work element thereto, said second frame including a circular portion;

a number of ring gear segments mounted to said circular portion in a circular array, each of said number of ring gear segments including gear teeth adapted for engaging drive means of said first frame to rotate said second frame relative to said first frame;

said circular portion and said number of ring gear segments defining an assembly slidingly disposed between said first bearing surface and said second bearing surface;

a number of first bearing members disposed between said circular portion and said first bearing surface; and a number of second bearing members disposed between said number of ring gear segments and said second bearing surface.

* * * * *